US012358675B2

(12) United States Patent
Isaka et al.

(10) Patent No.: US 12,358,675 B2
(45) Date of Patent: Jul. 15, 2025

(54) INFILLING-MATERIAL FORMATION FRAME DEVICE AND METHOD OF POSITIONING CIVIL-ENGINEERING WORK BAG

(71) Applicant: MAEDA KOSEN CO., LTD., Fukui (JP)

(72) Inventors: Shingo Isaka, Fukui (JP); Satoshi Kawabata, Fukui (JP); Kenki Tsubota, Fukui (JP)

(73) Assignee: MAEDA KOSEN CO., LTD., Fukui (JP)

( * ) Notice: Subject to any disclaimer, the term of this patent is extended or adjusted under 35 U.S.C. 154(b) by 0 days.

(21) Appl. No.: 18/466,843

(22) Filed: Sep. 14, 2023

(65) Prior Publication Data

US 2024/0017868 A1 Jan. 18, 2024

Related U.S. Application Data

(63) Continuation of application No. PCT/JP2021/046787, filed on Dec. 17, 2021.

(30) Foreign Application Priority Data

Mar. 18, 2021 (JP) ..... 2021-044614

(51) Int. Cl.
*B65B 67/04* (2006.01)
*B65B 67/12* (2006.01)

(52) U.S. Cl.
CPC ..... *B65B 67/1238* (2013.01)

(58) Field of Classification Search
CPC ..... B65B 67/1238; E02B 3/04
See application file for complete search history.

(56) References Cited

U.S. PATENT DOCUMENTS 3,276,733 A * 10/1966 Rosser ..... B65F 1/141 248/153
6,450,461 B1 * 9/2002 Lohmann ..... B65B 67/1238 248/97

(Continued)

FOREIGN PATENT DOCUMENTS

JP 4-60813 U1 5/1992
JP 2000-001828 A 1/2000

(Continued)

OTHER PUBLICATIONS

International Search Report for PCT/JP2021/046787, issued on Jan. 18, 2022, total p. 4.

(Continued)

*Primary Examiner* — Amy J. Sterling
(74) *Attorney, Agent, or Firm* — Apex Juris, pllc; Hilde Coeckx

(57) ABSTRACT

An infilling-material formation frame device for putting infilling material into a civil-engineering work bag made of knitted fabric, the infilling-material formation frame device comprising: a frame body having a shape tapered inversely toward an upper opening thereof opened upward; and one or a plurality of overhang handle arranged so as to protrude from an outer circumferential surface of the frame body having a positioning function to position and a stepping function to step the civil-engineering work bag, wherein the one or the plurality of overhang handle has a size larger than a mesh size of the knitted fabric of the civil-engineering work bag to such an extent that the civil-engineering work bag is not hooked on the one or the plurality of overhang handle.

9 Claims, 12 Drawing Sheets

(56) References Cited

U.S. PATENT DOCUMENTS

| | | | | |
|---|---|---|---|---|
| 6,651,942 | B1 * | 11/2003 | Yardley | B65B 67/1233 248/101 |
| 8,757,563 | B2 * | 6/2014 | Muse | B65B 67/1205 248/97 |
| 9,056,715 | B2 * | 6/2015 | Muse | B65F 1/1415 |
| 9,302,848 | B1 * | 4/2016 | Wadleigh | B65B 67/12 |
| 2006/0005466 | A1 * | 1/2006 | Atchley | A01G 9/024 47/39 |

FOREIGN PATENT DOCUMENTS

| | | | |
|---|---|---|---|
| JP | 2005-240348 | A | 9/2005 |
| JP | 3122664 | U | 6/2006 |
| JP | 2007-170092 | A | 7/2007 |
| JP | 2008-274698 | A | 11/2008 |
| JP | 2012-117280 | A | 6/2012 |
| JP | 2021-017729 | A | 2/2021 |

OTHER PUBLICATIONS

Notice of Reasons of Refusal dated Dec. 22, 2021, in counterpart Japanese Patent Application No. 2021-044614.

* cited by examiner

INFILLING-MATERIAL FORMATION FRAME DEVICE AND METHOD OF POSITIONING CIVIL-ENGINEERING WORK BAG

CROSS REFERENCE TO RELATED APPLICATIONS

This is a continuation application of International Patent Application No. PCT/JP2021/046787 filed on Dec. 17, 2021 claiming priority upon Japanese Patent Application No. 2021-044614 filed on Mar. 18, 2021, of which full contents are incorporated herein by reference.

BACKGROUND OF THE INVENTION

Field of the Invention

The present invention relates to an infilling-material formation frame device and a method of positioning a civil-engineering work bag applicable for putting infilling material such as natural stone or concrete debris into a civil-engineering work bag to be used for various sorts of civil engineering work such as foot protection work, shore protection work, and temporary foundation work in the river or ocean, or on land.

Description of the Background Art

A civil-engineering work structure obtained as a result of putting infilling material into a civil-engineering work bag (hereinafter, referred to as "bag") has been widely known.

A conventional bag having a bag body made of mesh fabric includes: a lifting rope having an endless structure arranged around a mesh portion in proximity to an opening (mouth) of the bag body; and a mouth-narrowing rope for preventing the opening of the bag body from being opened (Patent Document 1).

A frame device has been used in the manufacture of a civil-engineering work structure by putting infilling material into the bag.

Such a civil-engineering work structure has been manufactured through: a setting step of setting the bag in the frame device; an putting-into step of putting infilling material into the bag; a mouth-narrowing step of narrowing to close an opening (mouth) end of the bag body with a mouth-narrowing rope; a drawing step of drawing a plurality of portions of a lifting rope having an endless structure from a plurality of points of the bag body, respectively; a hooking step of hooking collectively a plurality of drawn portions of the lifting rope with a hook such as a crane's hook; and a pulling-out step of lifting the civil-engineering work structure by a crane, e.g., to pull out the civil-engineering work structure from the frame device.

Patent Document 2 discloses a frame device including a tubularly-shaped frame body having upper and lower portions opened and capable of accommodating a bag in the tubularly-shaped frame body. The frame device has been configured such that the tubularly-shaped frame body has an upper opening capable of being opened and closed when pulling out the civil-engineering work structure from the frame device.

More specifically, the frame device has been configured such that the tubularly-shaped frame body has the upper opening is openable in an expandable manner thereby to enable the civil-engineering work structure to be easily pulled out therefrom.

Merely by setting a bag in the tubularly-shaped frame body, the set bag has been caused undesirably to be drawn into an inner side of the tubularly-shaped frame body by an operation of putting the infilling material into the bag.

Patent Document 3 discloses a frame device having pin-like attachment portions arranged so as to protrude at a periphery of a tubularly-shaped frame body, where such pin-like attachment portions are to be used to temporarily fix an opening end of a bag to the frame device, thereby to prevent the bag from being drawn into the tubularly-shaped frame body.

PRIOR ART DOCUMENTS

Patent Documents

Patent Document 1: Japanese Patent Application Laid-Open Publication No. 2000-1828

Patent Document 2: Japanese Patent Application Laid-Open Publication No. 2008-274698

Patent Document 3: Japanese Patent Application Laid-Open Publication No. 2012-117280

Problems to be Solved

A conventional frame device had the following problems to be solved:

[1] The frame device described in Patent Documents 1, 2 did not have any means for preventing the bag from being drawn into the frame body. For this reason, the bag was caused undesirably to be drawn into the frame body by an operation of putting infilling material into the bag, which has further caused inconvenience in subsequent operations to tighten the opening of the bag so as to lift the bag.

[2] The frame device described in Patent Document 3 had pin-like attachment portions arranged so as to protrude in a radial manner. For this reason, some knitted fabric of the bag was caught by such pin-like attachment portions during handling of the bag, which has reduced the handleability of the bag.

[3] When the knitted fabric of the bag body caught by the pin-like attachment portions receives any excessive tensile force, there has been a probability that the knitted fabric is torn.

[4] In order to temporarily fix the bag body to the frame device, the mouth-narrowing rope arranged for the bag body had to be hooked on the plurality of pin-like attachment portions arranged around a periphery of the frame device, which has thus required a long time to perform a temporarily-fixing operation.

[5] A certain level of tension was caused by putting infilling material into the bag to act on the knitted fabric of the bag body. For this reason, it has been difficult to separate the tensed mouth-narrowing rope from the plurality of pin-like attachment portions after having putted such infilling material into the bag.

[6] After having putted infilling material into the bag, it was necessary to perform, at the middle area of the frame device, the operations of: narrowing to close the opening of the bag body; drawing a plurality of portions of a lifting rope from their respective points of the bag body; and hooking collectively the plurality of drawn portions of the lifting rope with a hook such as a crane's hook.

Such a series of operations had to be performed at the middle area of the frame device by a worker leaning forward while both of the hands being stretched out. Such an unstable posture of the worker has resulted in lengthened time and enlarged physical burden.

Recently, in particular, the civil-engineering work structure having a larger size required the frame device to be of elevated height and enlarged diameter. This made it further difficult for the worker to perform the operations at the middle area of the frame device, which has thus caused decrease in efficiency to manufacture the civil-engineering work structure.

[7] When the frame device has an indivisibly integrated structure, a larger space has been required for the storage and transportation of such a frame device.

[8] When the frame device has an assembly-type divided structure for saving a space, it was difficult to stack stably a plurality of divided parts, which has caused another problem of if such stacked divided parts are likely to collapse to fall off during the storage or transportation.

SUMMARY OF THE INVENTION

The present invention has been made in view of the above-described technical problems. An objective of the invention, an infilling-material formation frame device and a method of positioning a civil-engineering work bag with respect to the infilling-material formation frame device, is provided as at least one of the items summarized below.

[1] knitted fabric of the civil-engineering work bag is prevented from being caught by the infilling-material formation frame device so that the handleability of the bag can be improved.

[2] The civil-engineering work bag can not only be easily positioned with respect to the infilling-material formation frame device but also be easily released from positioning with respect to such a frame device.

[3] Efficiency in the manufacture of the civil-engineering work structure through the use of the infilling-material formation frame device can be improved.

[4] The infilling-material formation frame device can be improved in the aspect of storage and transportation thereof.

Means for Solving Problems

A first aspect of the present invention is an infilling-material formation frame device for putting infilling material into a civil-engineering work bag made of knitted fabric, the infilling-material formation frame device comprising: a frame body having a shape tapered inversely toward an upper opening thereof opened upward; and one or a plurality of overhang handle arranged so as to protrude from an outer circumferential surface of the frame body having a positioning function to position and a stepping function to step the civil-engineering work bag, wherein the one or the plurality of overhang handle has a size larger than a mesh size of the knitted fabric of the civil-engineering work bag to such an extent that the civil-engineering work bag is not hooked on the one or the plurality of overhang handle.

A second aspect of the present invention is the infilling-material formation frame device in the above-described first aspect, wherein said infilling-material formation frame device includes an assembly-type divided structure body having a plurality of arc-shaped frames obtained as a result of dividing the frame body around an axial direction, and the plurality of arc-shaped frames have the one or the plurality of overhang handle arranged at an outer circumferential surface thereof.

A third aspect of the present invention is the infilling-material formation frame device in the above-described second aspect, wherein the plurality of arc-shaped frames have the plurality of overhang handles arranged on an outer circumferential surface of the frame body at the same height.

A fourth aspect of the present invention is the infilling-material formation frame device in any one of the above-described first to third aspects, wherein the one or the plurality of overhang handle is arranged at such a height that, when causing an upper half of the civil-engineering work bag accommodated within an interior of the frame body to be pendant down over an exterior of the frame body, a temporarily-tightening rope arranged around the civil-engineering work bag can be tightened below the one or the plurality of overhang handle thereby capable of positioning the civil-engineering work bag.

A fifth aspect of the present invention is the infilling-material formation frame device in any one of the above-described first to fourth aspects, wherein the plurality of overhang handles are intermittently or continuously arranged in a circumferential direction of the frame body.

A sixth aspect of the present invention or a seventh aspect of the present invention is the infilling-material formation frame device in the above-described fifth aspect, wherein the intermittently-arranged plurality of overhang handles may be laterally elongated in a circumferential direction of the frame body, or longitudinally elongated in an axial direction of the frame body, respectively.

An eighth aspect of the present invention is the infilling-material formation frame device in any one of the above-described first to seventh aspects, wherein the frame body may have a window-bar structure body obtained as a result of arranging a plurality of longitudinally-oriented frame members in parallel.

Further, a ninth aspect of the present invention is a method of positioning a civil-engineering work bag made of knitted fabric arranged around with a temporarily-tightening rope while preventing the civil-engineering work bag having been putted with infilling material from being drawn into an infilling-material formation frame device having an inversely-tapered shape, the method comprising the steps of: using the infilling-material formation frame device in any one of the above-described first to eighth aspects; causing an upper half of the civil-engineering work bag to be pendant down over an exterior of the infilling-material formation frame device; and tightening the temporarily-tightening rope below the one or the plurality of overhang handle having a positioning function to position and a stepping function to step the civil-engineering work bag, whereby capable of positioning the civil-engineering work bag with respect to the infilling-material formation frame device.

A tenth aspect of the present invention is the method of positioning a civil-engineering work bag in the above-described ninth aspect, wherein the civil-engineering work bag includes: a lifting rope arranged apart from an opening of a bag body thereof; a mouth-narrowing rope arranged in proximity to the opening of the bag body; and an intermediate-mouth narrowing rope arranged at a portion of the bag body below the lifting rope, and wherein any one of the lifting rope, mouth-narrowing rope, and intermediate-mouth narrowing rope also serves as the temporarily-tightening rope.

Advantageous Effects Achieved by the Invention

According to the above-described aspects, the present invention can achieve at least one of the effects described below.

[1] The overhang handle of the infilling-material formation frame device has a size larger than a mesh size of the knitted fabric of the civil-engineering work bag by a degree that the knitted fabric of the civil-engineering work bag is prevented from being caught by the overhang handle. As a result, the handleability of the civil-engineering work bag in the manufacture of the civil-engineering work structure can be improved.

[2] The civil-engineering work bag can be tightened temporarily below the overhang handle by the temporarily-tightening rope to the infilling-material formation frame device. The civil-engineering work bag can, therefore, be securely prevented from being drawn into the frame body during putting infilling material into the civil-engineering work bag.

[3] Merely by tightening the temporarily-tightening rope arranged around the civil-engineering work bag at a portion of such a work bag below the overhang handle, the civil-engineering work bag can be positioned with respect to the infilling-material formation frame device. Further, merely by untightening the above-tightened temporarily-tightening rope can be released from positioning the civil-engineering work bag with respect to the infilling-material formation frame device.

[4] A worker can use the overhang handle arranged on the infilling-material formation frame device as a footstep. As a result, the worker can effectively perform, while having a stable posture, the operations to be performed at the middle area of the frame device, such as an operation to tighten the mouth-narrowing rope arranged on the bag and an operation to draw the plurality of portions of the lifting rope arranged on the bag. As a consequence, the worker can perform such a series of operations at the middle area of the frame device with a significantly reduced physical burden.

[5] During the manufacture of the civil-engineering work structure, the civil-engineering work bag can be prevented from being caught by the overhang handle. The positioning of the civil-engineering work bag can also be easily enabled to the frame device and released from the frame device. The preparation for lifting the civil-engineering work bag after having putted infilling material thereinto can also be made efficiently. Efficiency in the manufacture of the civil-engineering work structure can be improved in comparison with that in a conventional case.

[6] When the frame body has the assembly-type divided structure body having the plurality of arc-shaped frames, the overhang handle arranged on the arc-shaped frame can be used for stacking such a plurality of arc-shaped frames in a stable manner. As a result, the infilling-material formation frame device can be improved in the aspect of storage and transportation thereof.

DESCRIPTIONS OF EMBODIMENTS OF THE INVENTION

Hereinafter, embodiments according to the present invention will be described in detail with reference to the drawings.

First Embodiment

[1] Infilling-Material Formation Frame Device

An infilling-material formation frame device 10 (hereinafter, referred to as "frame device") will be described below based on the definition that the term "circumferential direction" includes a direction along the circumference around the axis of the frame device 10 and the term "axial direction" includes a direction along the central axis of the frame device 10.

Figure 8:
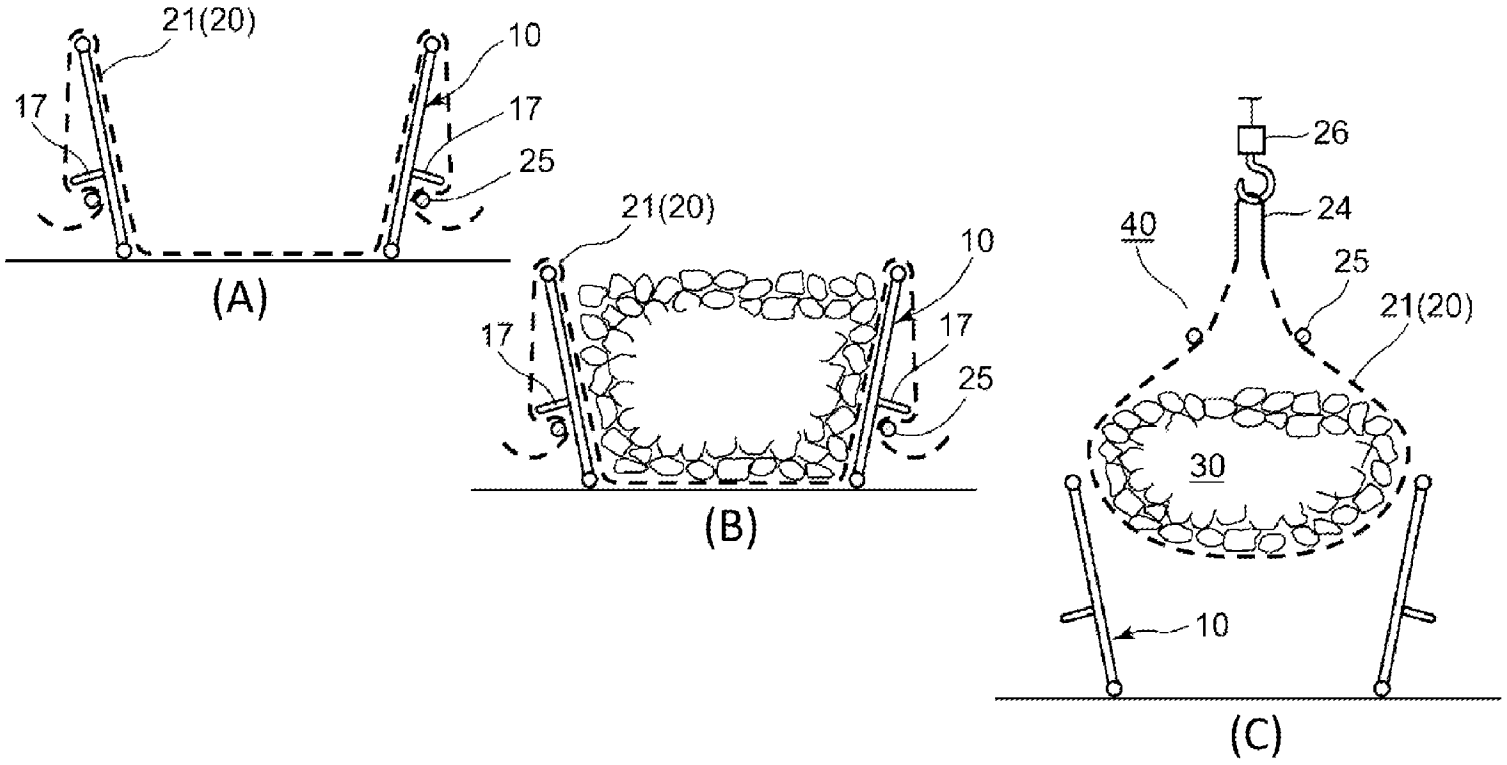
FIG. 8 depicts an explanatory view showing a method of manufacturing a civil-engineering work structure: a series of steps until setting the civil-engineering work bag in the infilling-material formation frame device in (A); a series of steps until putting infilling-material into the civil-engineering work bag in (B); and a series of steps until pulling out the civil-engineering work structure from the infilling-material formation frame device in (C).

As shown in FIG. 8, the frame device 10 is a tubularly-shaped frame to be applied when putting infilling material 30 into a bag 20 thereby to manufacture a civil-engineering work structure 40.

The frame device 10 has an overhang handle 17 arranged at an outer periphery thereof. The bag 20 set in the frame device 10 can be prevented from being drawn into the frame device 10 as a result of combining such an overhang handle 17 of the frame device 10 with a temporarily-tightening rope (intermediate mouth-narrowing rope 25) arranged to the bag 20.

[1.1] Shape as a Whole of Frame Device

Figure 1:
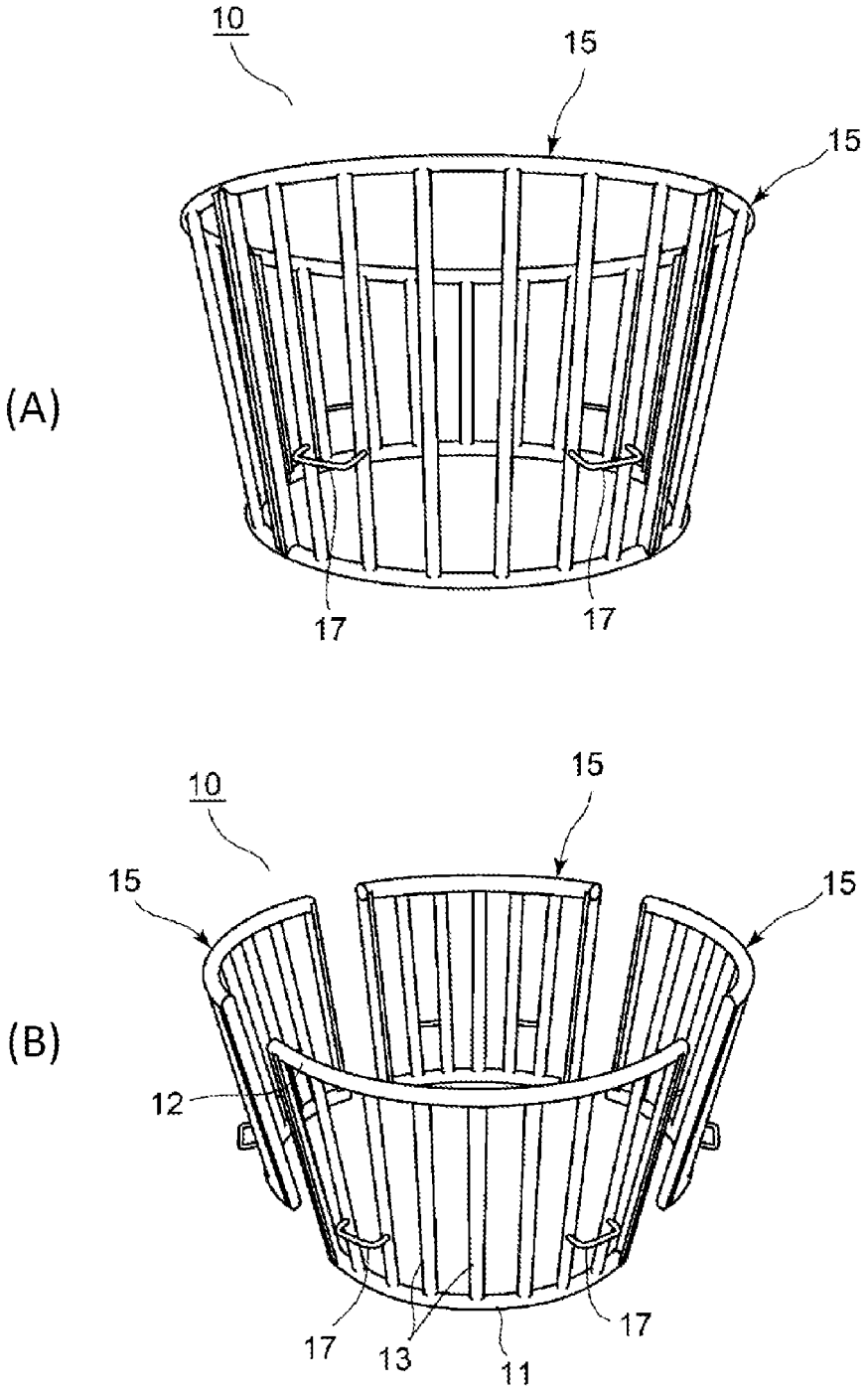
FIG. 1 depicts a view of an infilling-material formation frame device according to First Embodiment of the present invention: as-built view in (A) and exploded view in (B).
Figure 2:
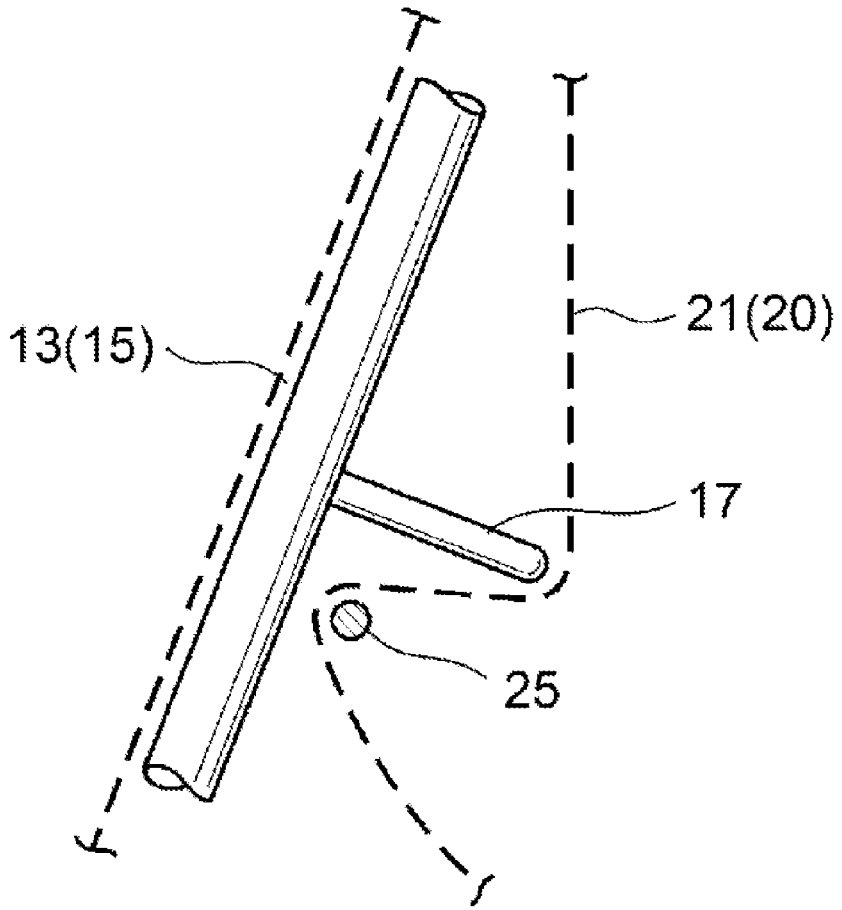
FIG. 2 depicts an enlarged view of an overhang handle.

As shown in FIGS. 1, 2, the frame device 10 has a frame body in a shape tapered inversely (inversely-truncated conical shape) as a whole so that the civil-engineering work structure 40 can be easily pulled out therefrom.

A height of the frame device 10 and diameters of an upper and a lower parts may be appropriately selected.

A taper angle of the frame device 10 may be appropriately selected but is desirably within a range of 20° to 30° for a practical reason.

[1.2] Assembly-Type Divided Structure of Frame Body

In an embodiment according to the present invention, an assembly-type divided structure of the frame body will be described. In order to achieve space-saving storage and transportation, the frame device 10 has a frame body having a plurality of arc-shaped frames 15 obtained as a result of dividing the frame body about an axial direction. The plurality of arc-shaped frames 15 each having end faces 16 at both sides thereof can provide an assembly-type divided structure as a result of connecting between adjacently arranged end faces 16 by connection means.

[1.3] Material of Frame Body

The frame body is produced by combining rod members or pipe members as material in longitudinal and lateral directions.

In an embodiment according to the present invention, the arc-shaped frame 15 is produced by laterally-oriented lower, upper frame members 11, 12 and a plurality of longitudinally-oriented frame members 13. The arc-shaped frame 15 has a window-bar structure body obtained as a result of arranging the plurality of longitudinally-oriented frame members 13 around an axial direction so as to connect lower and upper portions thereof with arc-shaped laterally-oriented lower and upper frame members 11 and 12, respectively.

Material of the frame body is not limited to rod members or pipe members but may be a rigid sheet body made of metal sheet, resin sheet, and the like.

[1.4] Number of Division of Frame Device

In an embodiment according to the present invention, it will be described that the frame device 10 is divided into four pieces.

The frame device 10 may be divided into an arbitrary number of pieces so long as the number is two or more.

[1.5] Overhang Handle

The frame device 10 has an overhang handle 17 or overhang handles 17 arranged so as protrude in a circumferential direction at an outer periphery thereof.

The overhang handles 17 may be arranged to all arc-shaped frames 15 or may be selectively arranged to some of all the arc-shaped frames 15.

When a plurality of overhang handles 17 are arranged to the arc-shape frame 15 or arc-shaped frames 15, such overhang handles 17 are arranged in parallel at the same height with intervals therebetween.

The overhang handle 17 can not only serve as a handle of the arc-shaped frame 15 but also serve as position means to position while preventing the bag 20 set in the frame device 10 from being drawn into the frame device 10 and serve as step means for a worker to step when working above the frame device 10.

The overhang handles 17 arranged in parallel at the same height on an outer surface of the arc-shaped frames 15 of the frame device 10 can cause the arc-shaped frames 15 to be stacked while preventing such stacked arc-shaped frames 15 from fluctuating freely.

[1.5.1] Height for Arrangement of Overhang Handle

In order to allow the overhang handle 17 to serve as position means to position the bag 20 set in the frame device 10, a height for the arrangement of the overhang handle 17 is predetermined such that a temporarily-tightening rope (intermediate-mouth narrowing rope 25) around a portion of the bag 20 pendant down over an exterior of the frame device 10 is positioned below the overhang handle 17.

More specifically, a height for the arrangement of the overhang handle 17 is adjusted in consideration of, e.g., an overall size of the bag 20 and a position at which the temporarily-tightening rope (intermediate-mouth narrowing rope 25) is arranged.

[1.5.2] Shape of Overhang Handle

The overhang handle 17 may be arbitrarily shaped so long as the above-described functions can be achieved.

In an embodiment according to the present invention, the overhang handle 17 is obtained as a result of bending a rod member into a laterally-elongated U-like shape so that it has both ends bridging laterally their respective longitudinally-oriented frame members 13 arranged adjacently to each other. The overhang handle 17, however, is not limited to such a U-like shape but may be made of a semicircular-shaped rod member.

The overhang handle 17 is not limited to a rod member but may be a sheet-like plate member.

[1.5.3] Protrusion Angle of Overhang Handle

As shown in FIG. 2, the overhang handle 17 is arranged so as to protrude in a slightly slanting position with respect to a horizontal line.

Such an overhang handle 17 arranged in a slightly-slanting position can suppress any coming-off of the temporarily-tightening rope (intermediate-mouth narrowing rope 25) from the frame device 10, thereby capable of improving a function to position the bag 20 with respect to the frame device 10.

[1.5.4] Overhang Handle and Interval of Longitudinally-Oriented Frame Members

Each overhang handle 17 whose both ends bridge laterally longitudinally-oriented frame members 13 and such longitudinally-oriented frame members 13 are related in size such that: the overhang handle 17 on one arc-shaped frame 15 cannot be inserted into an interval between the adjacently-arranged longitudinally-oriented frame members 13 on another arc-shaped frame 15, when the arc-shaped frames 15 are stacked together.

[2] Connection Means

A plurality of arc-shaped frames 15 can be assembled or disassembled via connection means.

Figure 3:
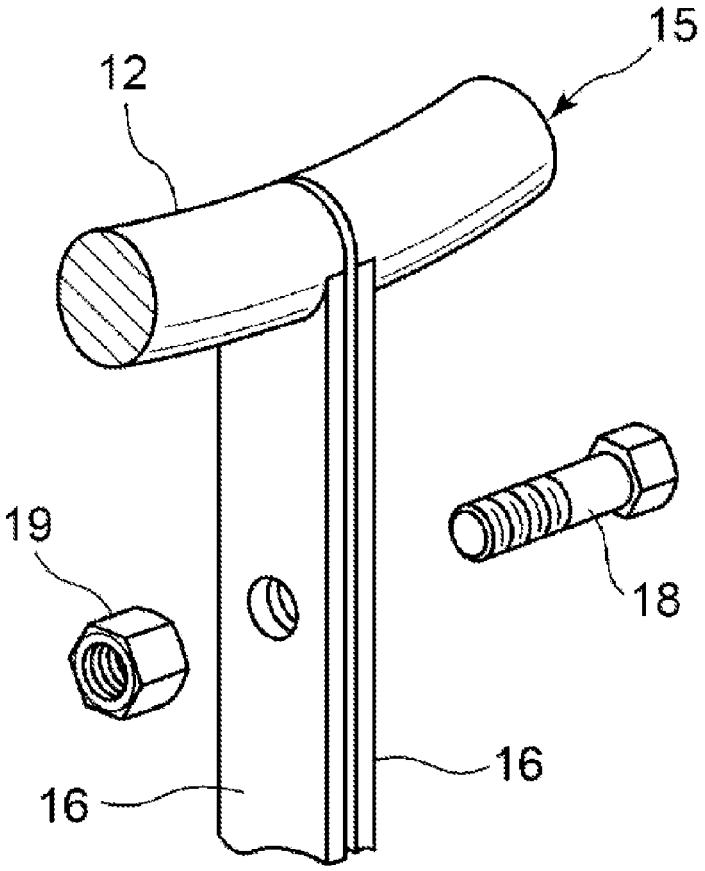
FIG. 3 depicts an enlarged cross-sectional view showing how adjacently arranged arc-shaped frames are joined to each other.

As shown in FIG. 3, in an embodiment according to the present invention, a bolt 18 and nut 19 are used for connecting adjacently-arranged end plates 16, 16: an end plate 16 of both end plates 16, 16 of one of adjacently-arranged arc-shaped frames 15, 15; and an end plate 16 of both end plates 16, 16 of the other of adjacently-arranged arc-shaped frames 15, 15.

Connection means for connecting the arc-shaped frames 15 is not limited to the bolt 18 and nut 19. The connection means may also be a grip metal fitting capable of tightening adjacently-arranged end plates 16, 16: an end plate 16 of both end plates 16, 16 of one of adjacently-arranged arc-shaped frames 15, 15; and an end plate 16 of both end plates 16, 16 of the other of adjacently-arranged arc-shaped frames 15, 15. The connection means may alternatively be a tightening belt for tightening entirely the frame device 10 obtained as a result of assembling the plurality of arc-shaped frames 15 in a cylindrical shape.

[3] Civil Engineering Work Bag (Bag)

Figure 4:
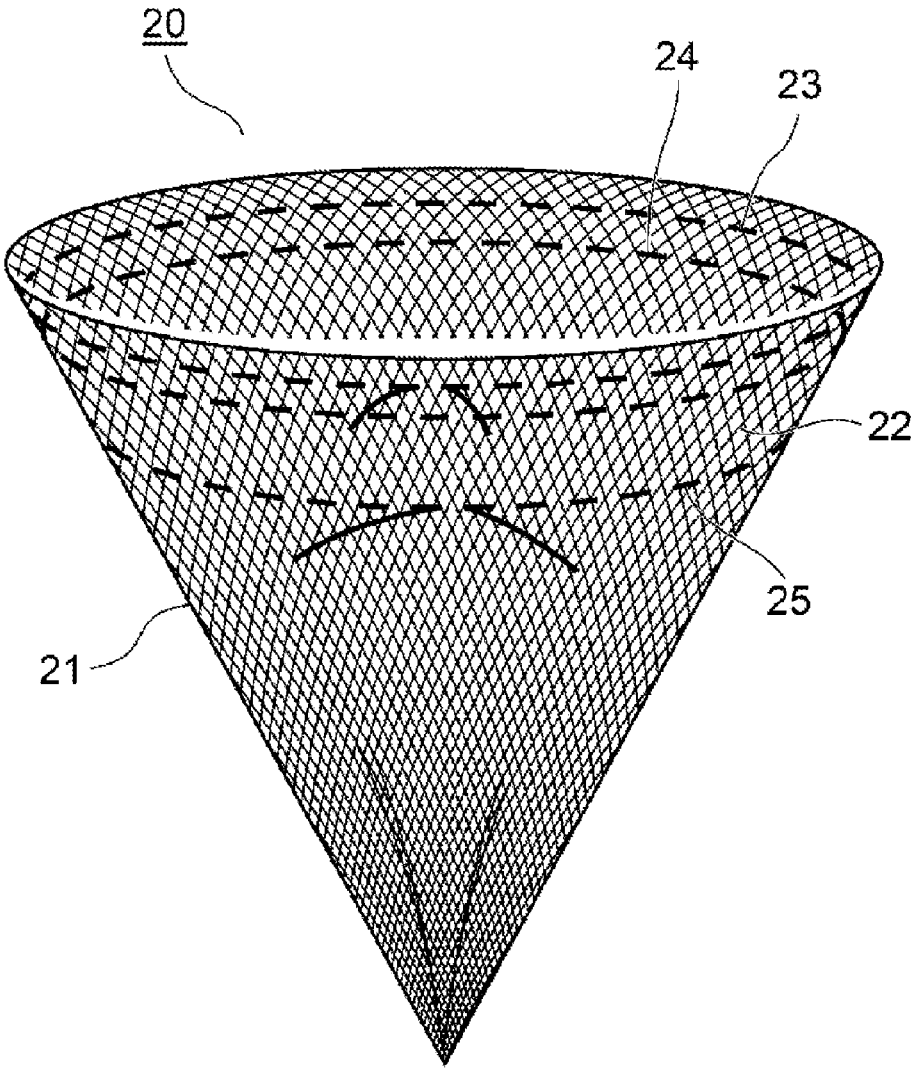
FIG. 4 depicts a perspective view of a civil-engineering work bag.
Figure 5:
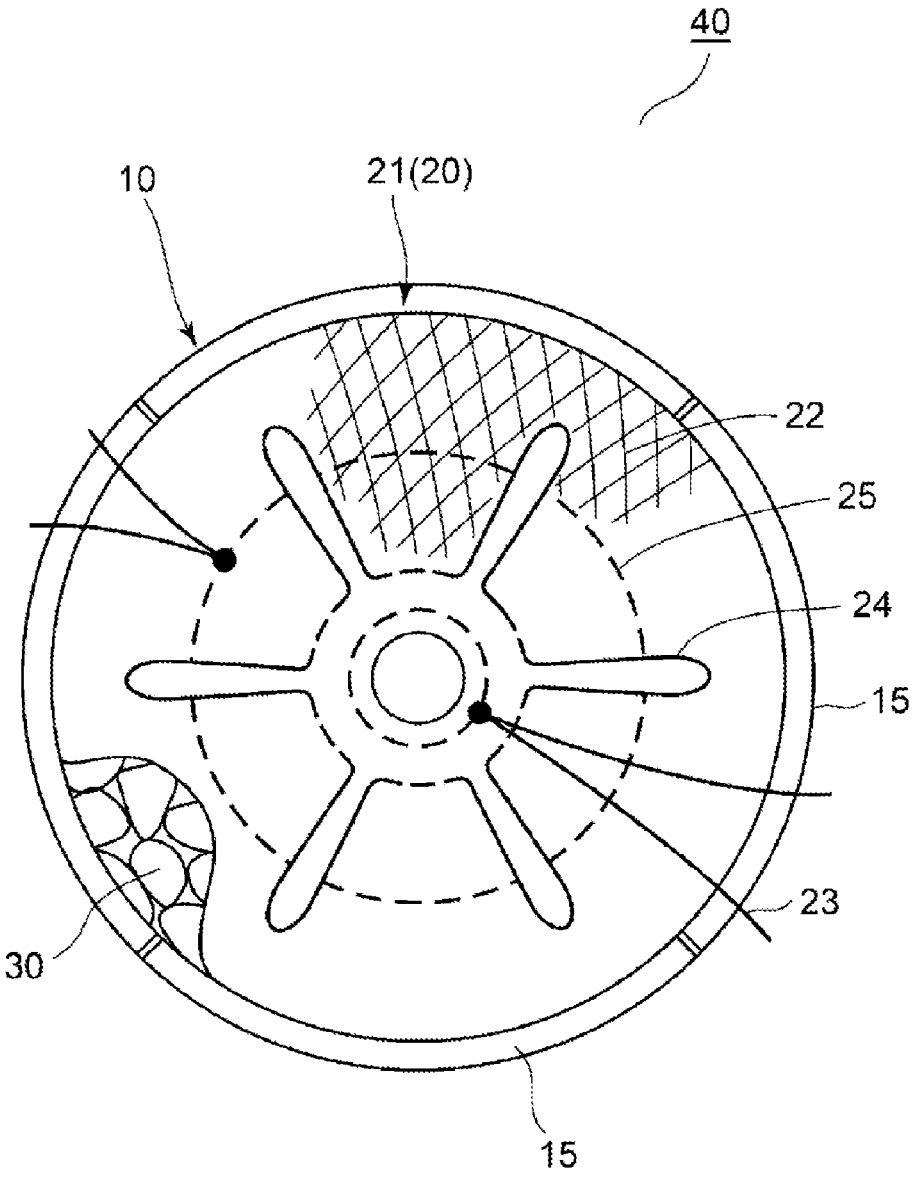
FIG. 5 depicts a plan view of a civil-engineering work structure placed in the infilling-material formation frame device.

As shown in FIGS. 4, 5, the civil engineering work bag 20 (hereinafter, referred to as "bag 20") used in an embodiment according to the present invention will be described below.

The bag 20 includes a mesh-like bag body 21 to be putted with infilling material 30 and a plurality of ropes (mouth-narrowing rope 23, lifting rope 24, intermediate-mouth narrowing rope 25) arranged in proximity to the opening (mouth) of the bag body 21.

[3.1] Bag Body

The bag body 21 is a bottomed bag made of net fabric having the opening.

The bag body 21 has external dimensions different from one another depending upon an amount of infilling material 30 (1 to 8 tons) accommodated therein.

The bag body 21 can be made of net fabric such as super-thick raschel net fabric obtained as a result of, e.g., double-knitting synthetic fiber yarns of polyester.

The net fabric has rectangularly or hexagonally-shaped mesh 22 in a bag (20)'s imaginarily developed state.

The mesh 22 has such a mesh size as to prevent infilling material 30 from passing therethrough from an interior toward an exterior. The mesh 22 has a general mesh size of 25 to 50 mm.

[3.2] Size of Overhang Handle and Mesh Size

Figure 6:
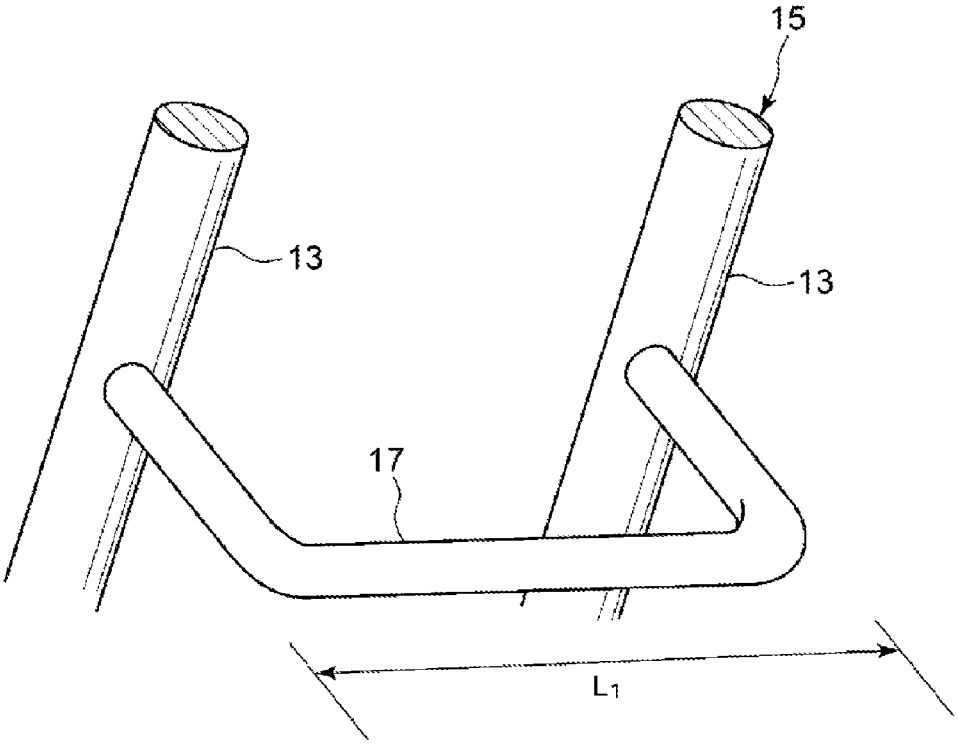
FIG. 6 depicts a perspective view of the overhang handle.
Figure 7:
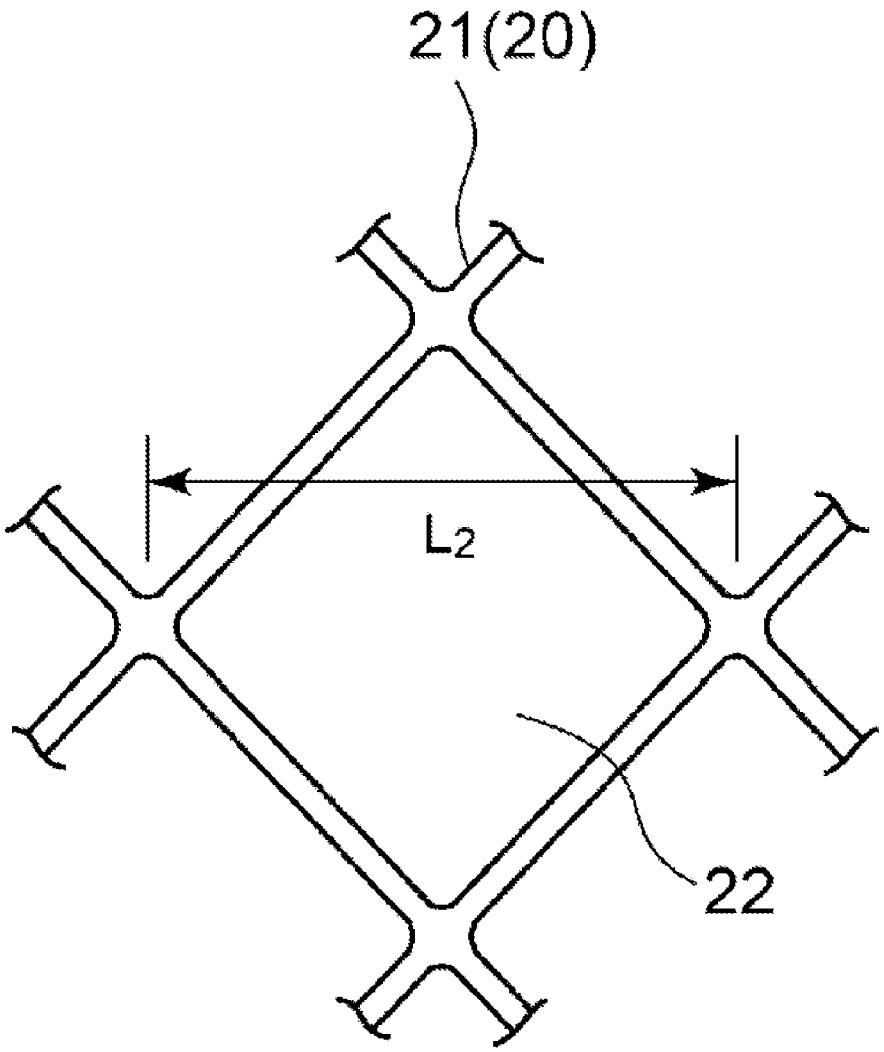
FIG. 7 depicts a partially enlarged view of knitted fabric of a bag body.

As shown in FIGS. 6, 7, a relation between a size of the overhang handle 17 of the frame device 10 and a mesh size of the bag body 21 will be described below.

The overhang handle 17 has the maximum (entire) width $L_1$ larger than the maximum (entire) width $L_2$ of the mesh 22 of knitted fabric of the bag body 21.

The overhang handle 17 has a size larger than a size of the mesh 22 in order to prevent the knitted fabric of the bag 20 from being hooked on the overhang handle 17 during handling of the bag 20.

[3.3] Ropes of Bag Body

As shown in FIGS. 4, 5, a plurality of ropes arranged for the bag body 21 will be described below.

The bag body 21 has, in proximity to the opening, three ropes, which are a mouth-narrowing rope 23, a lifting rope 24, and an intermediate-mouth narrowing rope 25, arranged to the bag body 21 from an opening side toward a bottom side in an order of the mouth-narrowing rope 23, the lifting rope 24, and the intermediate-mouth narrowing rope 25.

The mouth-narrowing rope 23 is a rope arranged at a closest position to the opening (mouth) of the bag body 21 having a function to open and close the opening of the bag body 21.

The lifting rope 24 is a rope having an endless structure to be arranged to the bag body 21 as a result of passing through the mesh between the mouth-narrowing rope 23 and the intermediate-mouth narrowing rope 25.

The intermediate-mouth narrowing rope 25 is a composite rope having a function to cause a constriction to occur at a part of the bag body 21 surrounding the infilling material 30 and also having a function substantially as a mouth-narrowing rope (as seen in (C) of FIG. 8).

Such a constriction is caused to occur at a part of the bag body 21 for the purpose of reducing, when the bag body 21 is lifted through the use of the lifting rope 24, a lifting angle at which a top portion of the bag body 21 (neck portion) is lifted in order to prevent the mesh allowing the lifting rope 24 to pass therethrough from being torn. Another purpose of such a constriction is to flexibly hold, after the civil-engineering work structure 40 is installed, a periphery of a top end surface of the infilling material 30 by a shoulder of an unhousing portion of the bag body 21.

[3.4] Temporarily-Tightening Rope

An embodiment where the intermediate-mouth narrowing rope 25 arranged to the bag 20 serves as the temporarily-tightening rope of the bag body 21 set within an interior of the frame device 10 will be described below.

The temporarily-tightening rope of the bag body 21 is not only limited to the intermediate-mouth narrowing rope 25 but also may be the mouth-narrowing rope 23 or the lifting rope 24.

The temporarily-tightening rope of the bag body 21 may also be applied with an exclusively-tightening rope other than the ropes 23 to 25 arranged to the bag body 21 at an appropriate position thereof.

[4] Infilling Material

The infilling material 30 may be, e.g., natural aggregate such as cobble stones, concrete debris, or burned substance of various wastes.

For applying to the foot protection work, the infilling material 30 has a diameter of approximately 150 mm. The infilling material 30 may, however, have a size set appropriately depending upon an application purpose.

[Method of Manufacturing Civil-Engineering Work Structure]

Next, as shown in FIG. 8, a method of manufacturing a civil-engineering work structure through the use of the frame device 10.

[1] Preparation Before Putting Infilling Material into Bag ((A) of FIG. 8)

The above-described frame device 10 and bag 20 are prepared.

[1.1] Setting of Bag ((A) of FIG. 8)

The bag body 21 is accommodated within an interior of the frame device 10 so that the bag body 21 in an imaginarily developed state is along an inner side of the frame device 10.

An upper half of the bag body 21 extending beyond the frame device 10 is outwardly folded over to cover an outer periphery of the frame device 10.

The temporarily-tightening rope (e.g., intermediate-mouth narrowing rope 25) arranged to the bag body 2 is positioned below the overhang handle 17.

[1.2] Temporarily Tightening of Bag Body ((A) of FIG. 8)

The temporarily-tightening rope (intermediate-mouth narrowing rope 25) is tightened at a portion of the bag body 21 pendant down over an exterior of the frame device 10 below the overhang handle 17 such that the portion is fit temporarily to the exterior of the frame device 10.

An operation to fit temporarily the bag body 21 to the frame device 10 can be performed only by tightening the temporarily-tightening rope arranged in advance to the bag body 21 without any further need to cause such a temporarily-tightening rope to surround the frame device 10 being required.

[2] Putting Infilling Material into Bag Body ((B) of FIG. 8)

A heavy machine such as a backhoe is used to put a predetermined amount of infilling material 30 into the bag body 21.

The infilling material 30 is accumulated within an interior of the bag body 21 so as to extend along an inner circumferential surface of the frame device 10 thereby to press the bag body 21 against the inner circumferential surface of the frame device 10.

[2.1] Effect of Preventing Bag from being Drawn into Frame Device

During putting the infilling material 30 into the bag body 21, a portion of the bag body 21 pendant down over an exterior of the frame device 10 receives a tensile force acting thereon to draw into an interior of the frame device 10.

A portion of the bag body 21 pendant down over an exterior of the frame device 10 below the overhang handle 17 is tightened temporarily by the temporarily-tightening rope (intermediate-mouth narrowing rope 25), thereby to securely prevent the bag body 21 from being drawn into the frame device 10 during the infilling material 30 being putted thereinto.

[2.2] Prevention of Tear in Knitted Fabric of Bag Body

The bag body 21 covering the overhang handle 17 has the mesh 22 whose mesh size is set so as to prevent the mesh 22 from being hooked on the overhang handle 17 (FIGS. 6, 7).

Even upon receipt of any tensile force, the knitted fabric of the bag body 21 is prevented from being torn as a result of being hooked on the overhang handle 17.

[3] Preparation for Lifting (FIG. 5, (C) of FIG. 8)

A plurality of ropes 23 to 25 arranged to the bag body are handled below so as to prepare for a lifting operation.

[3.1] Release of Bag Body from Temporarily Tightening

After having putted the infilling material 30 into the bag body 21, the temporarily-tightening rope (intermediate-mouth narrowing rope 25) is untightened so that an upper face of the infilling material 30 is covered with the upper half of the bag body 21.

[3.2] Tightening with Rope and Drawing-Out of Parts of Rope

The mouth-narrowing rope 23 is tightened so as to close the opening of the bag body 21 while the bag body 21 being set within an interior of the frame device 10.

The intermediate-mouth narrowing rope 25 arranged to the bag body 21 is tightened to a predetermined circumferential length thereby to prevent both ends from being untightened or loosened.

The lifting rope 24 passing through the mesh of the bag body 21 has a plurality of portions drawn at their respective positions of the bag body 21 (e.g., six positions), and thereby each is formed in a loop-like shape.

The outer periphery of the frame device 10 has the overhang handle 17 arranged so as to protrude therefrom at a height away from above the ground.

A worker can use the overhang handle 17 as a footstep thereby capable of securely preparing for a series of lifting operations with a stable posture which operations include an operation of tightening two mouth-narrowing ropes 23, 25 above the middle area of the frame device 10 and an operation of drawing portions of a lifting rope 24.

[4] Pulling-Out from Frame Body ((C) of FIG. 8)

A plurality of portions of the lifting rope 24 drawn at their respective positions of the bag body 21 to be formed in loop-like shapes are hooked with a hook 26 such as a crane's hook.

The lifting rope 24 is lifted so as to be removed from the frame device 10, thereby to complete the manufacture of the civil-engineering work structure 40.

Upon pulling-out of the civil-engineering work structure 40, the frame device 10 has an inner circumferential surface having an inversely-tapered shape, and thereby the civil-engineering work structure 40 can be pulled out smoothly.

[Method of Stacking Arc-Shaped Frames]

Figure 9:
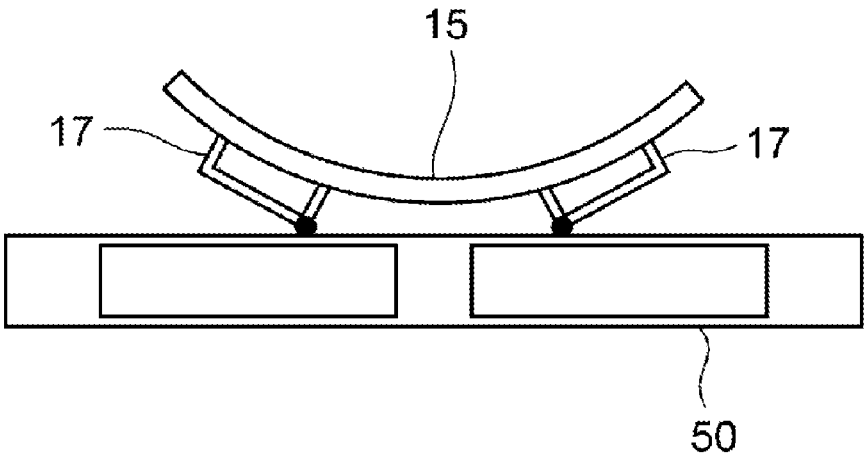
FIG. 9 depicts a schematic view of an arc-shaped frame placed on a palette.
Figure 10:
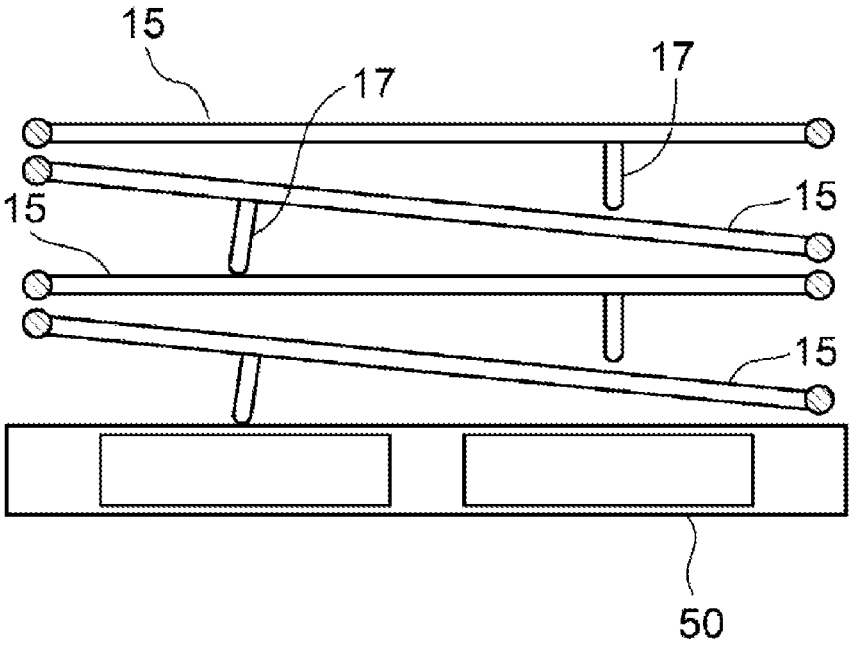
FIG. 10 depicts a schematic view of a plurality of arc-shaped frames stacked on a palette.

As shown in FIGS. 9, 10, a method of stacking arc-shaped frames 15 for the storage or transportation will be described below.

[1] Suppression of Fluctuation of Arc-Shaped Frame

If e.g. an arc-shaped frame is arranged laterally while a curved outer surface thereof without any overhang handle 17 facing in a downward direction on a surface such as a palette 50 or floor surface, there is a probability that such an arc-shaped frame would fluctuate.

Because of an arrangement shown in FIG. 9 where an outer periphery of the arc-shaped frame 15 has two overhang handles arranged in parallel, even if such an arc-shaped frame 15 is arranged laterally on e.g. a palette 50, the two overhang handles 17 abutting at two points on a surface such as the palette 50 can prevent the arc-shaped frame 15 from fluctuating freely.

[2] Posture of Stacked Arc-Shaped Frames

An arc-shaped frame without having any overhang handle 17, e.g., has an upper portion and a lower portion not only different in curvature from each other but also different in width and thickness from each other.

For this reason, if such a plurality of arc-shaped frames are stacked in such a posture that an upper and lower sides of each frame are aligned laterally, the stacked arch-shaped frames show an increase in inclination with elevating from a bottom toward a top thereof, which results in causing the arc-shaped frame to be unstable.

If the plurality of arc-shaped frames each oriented laterally are stacked as a result of reversing an upper and lower sides alternatively with respect to the adjacently-stacked ones, a fluctuation occurs between the adjacently-stacked upper and lower frames, which is unstable.

A similar event to the above-described ones occurs when the arc-shaped frames are stacked so that their respective curved surfaces face up in an upward direction.

In contrast to this, as shown in FIG. 10, the arc-shaped frames 15 each having the protruding overhang handle 17 are stacked in such an alternatively-reversed manner that: one arc-shaped frame 15 of laterally-aligned upper and lower sides is stacked adjacently to another arc-shaped frame 15 of laterally-aligned lower and upper sides. According to such arrangement, the overhang handle 17 can cancel the inclination of the arc-shaped frame 15 thereby to allow the plurality of arc-shaped frames 15 stacked in an up-and-down direction to have a stable posture.

In such a manner, the plurality of arc-shaped frames 15 including the overhang handles 17 can be stacked stably thereby capable of achieving space-saving storage and transportation for such a stably postured arc-shaped frames 15.

Second Embodiment

Hereinafter, other embodiments will be described. In the following description, the same elements as those in the first embodiment described above are denoted with the same reference numerals, and further detailed description will be omitted.

[1] Longitudinally-Oriented Overhang Handle

In the above first embodiment, an outer periphery of the frame device 10 having a laterally-oriented overhang handle 17 arranged so as to protrude therefrom is described. Such an overhang handle 17, however, may also be longitudinally-oriented in an axial direction of the frame body.

Figure 11:
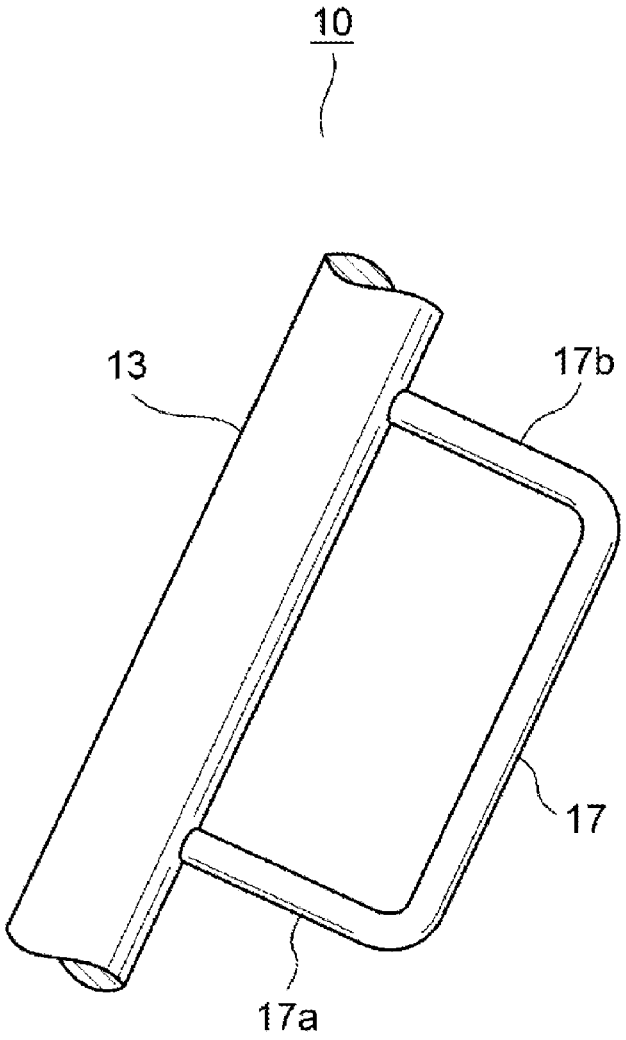
FIG. 11 depicts a view of a longitudinally-oriented overhang handle applied to an infilling-material formation frame device according to Second Embodiment.

FIG. 11 shows a longitudinally-oriented overhang handle 17 arranged so as to protrude from an outer periphery of the longitudinally-oriented frame member 13 of the frame body of the frame device 10.

A bottom face 17*a* of such an overhang handle 17 serves as a latch face for the temporarily-tightening rope, and an upper face 17*b* of such an overhang handle 17 serves as a footstep face for the worker.

[2] Effect of Embodiment

According to the second embodiment, effects similar to those of the above first embodiment can be achieved. One or a plurality of longitudinally-oriented overhang handle 17 enables the bag 20 to be positioned with respect to the frame body, and allows such an overhang handle 17 to be used by the worker as a footstep.

Third Embodiment

[1] Overhang Handles Continuous in Circumferential Direction

In the above first embodiment, a plurality of protruding overhang handles 17 arranged intermittently (or irregularly) in a direction of circumferential surface of the frame body of the frame device 10 are described. Such a plurality of protruding overhang handles 17, however, may also be arranged continuously in a projected manner in a direction of circumferential surface of the frame body.

Figure 12:
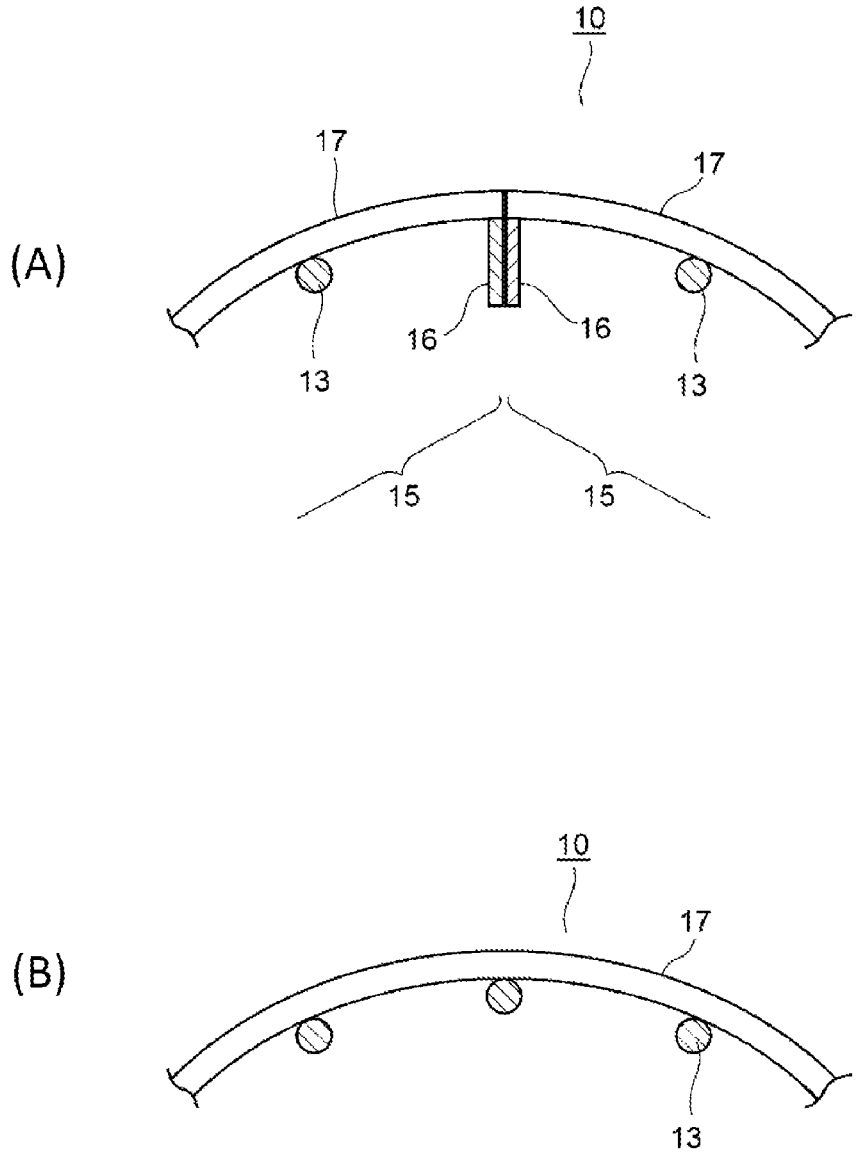
FIG. 12 depicts a view of an annularly-shaped overhang handle applied to an infilling-material formation frame device according to Third and Fourth Embodiments: a view of Third Embodiment of an arc-shaped overhang handle applied to each of a plurality of arc-shaped frames obtained as a result of dividing a frame body in (A); and a view of Fourth Embodiment of an annularly-shaped overhang handle having an integrated structure applied to a frame body in (B).

An arc-shaped overhang handle 17 arranged so as to protrude from an outer periphery of each arc-shaped frame 15 in a circumferential direction is shown in (A) of FIG. 12.

Such an overhang handle 17 has a length to cover laterally the arc-shaped frame 15. Both end faces of each arc-shaped frame 15 are fixed to their respective end plates 16, 16.

By connecting a plurality of arc-shaped frames 15 to assemble the frame device 10, an outer periphery of the frame body is allowed to have the arc-shaped frames 15 showing an annular shape.

[2] Effect of Embodiment

According to the second embodiment, effects similar to those of the above first embodiment can be achieved. The annularly-shaped overhang handle 17 enables the bag 20 to be positioned with respect to the frame body, and allows such an overhang handle 17 to be used by the worker as a footstep.

Fourth Embodiment

[1] Laterally-Oriented Overhang Handle

In the above first to third embodiments, the frame body of the frame device 10 has an assembly-type divided structure. Such a frame device 10, however, may also be prepared as an integrated structure without any need to divide the frame body.

In this embodiment, an overhang handle 17 may be applied with the overhang handle 17 described in the above first to third embodiments.

The overhang handle 17 in the above third embodiment is applied to this embodiment. An annularly-shaped overhang handle 17 arranged so as to protrude from an outer periphery of the frame device 10 in a circumferential direction of the frame body is shown in (B) of FIG. 12.

The overhang handle 17 may be directly fixed to an outer periphery of the frame body as a result of causing it to abut such an outer periphery. Alternatively, the overhang handle 17 may be arranged at an outer periphery of the frame body so as to protrude in a radial direction via various sorts of stay metal fitting.

[2] Effect of Embodiment

According to the fourth embodiment, the annularly-shaped overhang handle 17 enables the bag 20 to be positioned with respect to the frame body, and allows such an overhang handle 17 to be used by the worker as a footstep.

REFERENCE NUMERALS

10 Infilling-material formation frame device (frame device)
11 Laterally-oriented lower frame member
12 Laterally-oriented upper frame member
13 Longitudinally-oriented frame member
15 Arc-shaped frame
16 End face or End plate
17 Overhang handle
18 Bolt
19 Nut
20 Civil-engineering work bag (bag)
21 Bag body
22 Mesh
23 Mouth-narrowing rope
24 Lifting rope
25 Intermediate-mouth narrowing rope (temporarily-tightening rope)
30 Infilling material
40 Civil-engineering work structure
50 Palette

What is claimed is:

1. An infilling-material formation frame device for putting infilling material into a civil-engineering work bag made of knitted fabric, the infilling-material formation frame device comprising:

a frame body having a shape tapered inversely toward an upper opening thereof opened upward; and a plurality of overhang handles protruding from an outer circumferential surface of the frame body, and configured to position the civil-engineering work bag and to provide a footstep for a worker;

wherein each of the plurality of overhang handles has a size larger than a mesh size of the knitted fabric of the civil-engineering work bag to such an extent that the civil-engineering work bag is not hooked on the plurality of overhang handles;

wherein the plurality of overhang handles are arranged such that, when an upper half of the civil-engineering work bag accommodated within an interior of the frame body hangs down over an exterior of the frame body, a temporarily-tightening rope arranged around the civil-engineering work bag can be tightened below the plurality of overhang handles thereby positioning the civil-engineering work bag; and wherein each of the plurality of overhang handles includes a bottom face forming a latch for the temporarily-tightening rope and an upper face for the worker to step on.

2. The infilling-material formation frame device according to claim 1, wherein said infilling-material formation frame device includes an assembly-type divided structure body having a plurality of arc-shaped frames obtained as a result of dividing the frame body around an axial direction, and the plurality of arc-shaped frames have the plurality of overhang handles arranged at an outer circumferential surface thereof.

3. The infilling-material formation frame device according to claim 2, wherein the plurality of arc-shaped frames have the plurality of overhang handles arranged on an outer circumferential surface of the frame body at the same height.

4. The infilling-material formation frame device according to claim 1, wherein the plurality of overhang handles are intermittently arranged in a circumferential direction of the frame body.

5. The infilling-material formation frame device according to claim 4, wherein the intermittently-arranged plurality of overhang handles are laterally elongated in a circumferential direction of the frame body.

6. The infilling-material formation frame device according to claim 4, wherein the intermittently-arranged plurality of overhang handles are longitudinally elongated in an axial direction of the frame body.

7. The infilling-material formation frame device according to claim 1, wherein the frame body has a window-bar structure body obtained as a result of arranging a plurality of longitudinally-oriented frame members in parallel.

8. A method of positioning a civil-engineering work bag made of knitted fabric arranged around a frame body of an infilling-material formation frame device with a temporarily-tightening rope while preventing the civil-engineering work bag filled with infilling material from being drawn into the infilling-material formation frame device, the frame body having an inversely-tapered shape toward an upward opening thereof, the method comprising the steps of:

using the infilling-material formation frame device including a plurality of overhang handles protruding from an outer circumferential surface of the frame body, each having a bottom face forming a latch for the temporarily-tightening rope and an upper face for a worker to step on, and each one of the plurality of overhang handles having a size larger than a mesh size of the knitted fabric of the civil-engineering work bag to such an extent that the civil-engineering work bag is not hooked thereon;

causing an upper half of the civil-engineering work bag accommodated within an interior of the frame body to hang down over an exterior of the frame body; and tightening the temporarily-tightening rope below the plurality of overhang handles to position the civil-engineering work bag with respect to the infilling-material formation frame device.

9. The method of positioning the civil-engineering work bag according to claim 8, wherein the civil-engineering work bag includes:

a lifting rope arranged apart from the upward opening of the civil-engineering work bag;

a mouth-narrowing rope arranged in proximity to the upward opening of the civil-engineering work bag; and an intermediate-mouth narrowing rope arranged at a portion of the civil-engineering work bag below the lifting rope, and wherein any one of the lifting rope, mouth-narrowing rope, and intermediate-mouth narrowing rope also serves as the temporarily-tightening rope.

* * * * *